US008384492B2

(12) United States Patent
Cheng et al.

(10) Patent No.: US 8,384,492 B2
(45) Date of Patent: Feb. 26, 2013

(54) COAXIAL LINE TO MICROSTRIP CONNECTOR HAVING SLOTS IN THE MICROSTRIP LINE FOR RECEIVING AN ENCIRCLING METALLIC PLATE

(75) Inventors: Jui-Ching Cheng, Taipei (TW); Eric S. Li, Taipei (TW); Wen-Fu Chou, Taipei (TW); Kuan-Lin Huang, Madou Township (TW)

(73) Assignee: National Taipei University of Technology (TW)

( * ) Notice: Subject to any disclaimer, the term of this patent is extended or adjusted under 35 U.S.C. 154(b) by 263 days.

(21) Appl. No.: 12/876,450

(22) Filed: Sep. 7, 2010

(65) Prior Publication Data

US 2012/0056696 A1 Mar. 8, 2012

(51) Int. Cl.
*H01P 5/02* (2006.01)
*H01P 1/04* (2006.01)

(52) U.S. Cl. ..... 333/33; 333/260

(58) Field of Classification Search ..... 333/33, 333/260
See application file for complete search history.

(56) References Cited

U.S. PATENT DOCUMENTS 7,443,272 B2 * 10/2008 Jiang et al. ..... 333/260
2004/0119557 A1 * 6/2004 Barnes et al. ..... 333/33

* cited by examiner

*Primary Examiner* — Benny Lee
(74) *Attorney, Agent, or Firm* — Schmieser, Olsen & Watts, LLP

(57) ABSTRACT

A connector comprises a coaxial connector and a metallic plate. The coaxial connector has an outer conductor, a dielectric material, a mounting wall, and a center conductor. The space between the two conductors is filled with the dielectric material. The center conductor is extended from the inside of the coaxial connector to the other side of the mounting wall. The metallic plate has a through hole and is attached to the mounting wall of the coaxial connector. The outside center conductor of the coaxial connector is placed within the through hole. Hence, the connector improves the transmission passband of the transition between a coaxial line and a microstrip line at high frequencies.

16 Claims, 5 Drawing Sheets

COAXIAL LINE TO MICROSTRIP CONNECTOR HAVING SLOTS IN THE MICROSTRIP LINE FOR RECEIVING AN ENCIRCLING METALLIC PLATE

FIELD OF THE TECHNOLOGY

The present invention relates to a connector, in particular to a connector having a metallic plate to improve the signal transmission between a coaxial line and a microstrip line.

BACKGROUND

Due to the advancement of current electronic and information technologies, various communication and information products have been developed to meet daily requirements. Among the communication products, flange-mount SMA connectors are extensively used around the world for many high-frequency devices. The connectors are normally used at the input and output ports of the devices to provide transitions between a coaxial line and a planar transmission line in order to facilitate the testing of the devices.

Another application is the connection between different transmission lines, which is usually required in system integration. For example, connections between a coaxial line and a microstrip line; a coaxial line and a coplanar waveguide; a coaxial line and a waveguide; and a waveguide and a microstrip line, wherein the connection between the coaxial line and the microstrip line is the most common combination. To achieve successful signal transmission between these two transmission lines with minimum insertion loss, the designs of their transitions become very important.

With reference to FIGS. 1A and 1B for a schematic view of a conventional flange-mount SMA connector and a schematic view of a conventional transition between a coaxial line and a microstrip line using such SMA connector, respectively, the conventional flange-mount SMA connector 100 is a coaxial connector, comprising an outer conductor 111, a mounting wall 120, a center conductor 130, and a dielectric material 122. The transition is mainly used for high-frequency test setups or the input and output ports of high-frequency devices for signal transmission between the coaxial line (not shown in the figures) and the microstrip line 140. This conventional transition requires the center conductor 130 of the flange-mount SMA connector 100 connected to the signal line 142 on the substrate 143 of the microstrip line 140, and then needs the outer conductor 111 and the mounting wall 120 of the coaxial connector electrically connected to the ground plane 141 of the microstrip line 140 to accomplish the signal transmission between the two transmission lines, as shown in FIG. 1B.

With reference to FIGS. 2A and 2B for the electric field and magnetic field distributions of a coaxial line and a microstrip line, respectively, the differences in the electric field and magnetic field distributions of the two transmission lines result in insertion loss at the transition between the two transmission lines. The loss becomes severe as the operating frequency increases and, thus, constrains the 1-dB passband of the conventional transition.

Therefore, it is important for the present invention to disclose a connector capable of reducing the insertion loss caused by the change of the electric field and magnetic field distributions of the two transmission lines at the transition.

SUMMARY OF THE INVENTION

In view of the disadvantages of the prior art, the inventors of the present invention, based on years of experience related to that product, conducted extensive research and experiments, and finally developed a connector with a metallic plate. The goal is to reduce the insertion loss caused by the change of electromagnetic field distributions of the two transmission lines at their transition.

The primary goal of the present invention is to provide a connector with a metallic plate to reduce the insertion loss caused by the change of electromagnetic field distributions of the two transmission lines at their transition. Thus, the objective of improving the 1-dB passband of the frequency response of the transition between a coaxial line and a microstrip line is achieved.

To achieve the aforementioned goal, the present invention provides a connector to connect a coaxial line and a microstrip line. The microstrip line has a signal line, a substrate, and a ground plane. The signal line is on one side of the substrate, and the ground plane is on the other side. Two slots are cut on the edge of the substrate of the microstrip line near the transition and are separated by the signal line. The ground plane of the microstrip line between the two slots must be removed. The connector has two parts, a coaxial connector and a metallic plate. The coaxial connector has an outer conductor, a dielectric material, a mounting wall, and a center conductor. The space between the outer and center conductors is filled with the dielectric material. The center conductor is extended from the inside of the coaxial connector to the other side of the mounting wall. The metallic plate has a through hole and is attached to the mounting wall of the coaxial connector. The outside center conductor of the coaxial connector is placed within the through hole. For the connector of the present invention, the coaxial connector is used to connect the coaxial line. The through hole contains the microstrip line between the two slots with its ground plane removed. The two slots enable the metallic plate to encircle the ground plane-removed microstrip line. The outside center conductor is in direct contact with the signal line of the ground plane-removed microstrip line within the through hole. And the metallic plate is electrically connected to the ground plane of the microstrip line.

Therefore, the connector of the present invention can improve the frequency response of a transition between a coaxial line and a microstrip line at high frequencies.

DETAILED DESCRIPTION OF THE INVENTION

To fully understand the objectives, characteristics, and functions of the present invention, a preferred embodiment given below is combined with illustrated figures to provide detailed explanations as follows.

Figure 3A:
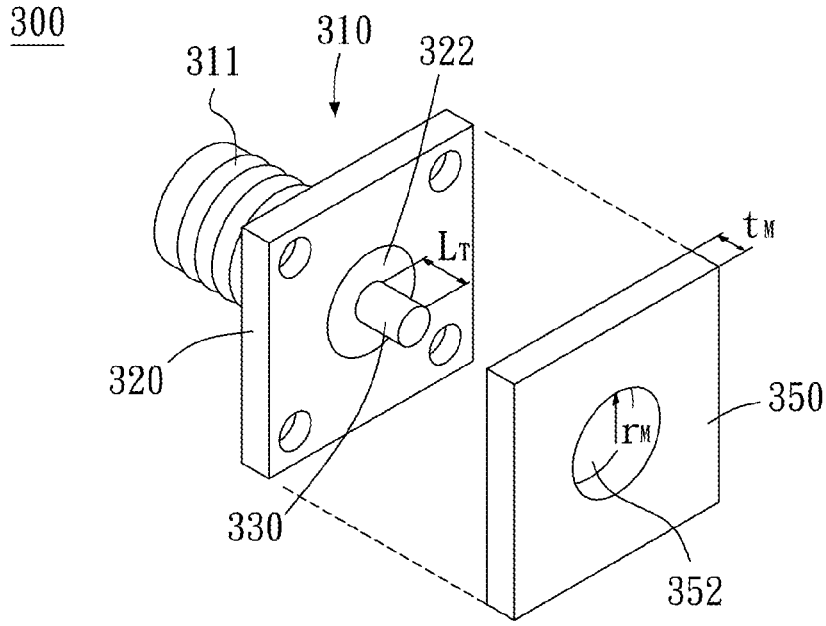
FIG. 3A is the schematic decomposed view of a preferred embodiment of the present invention.
Figure 3B:
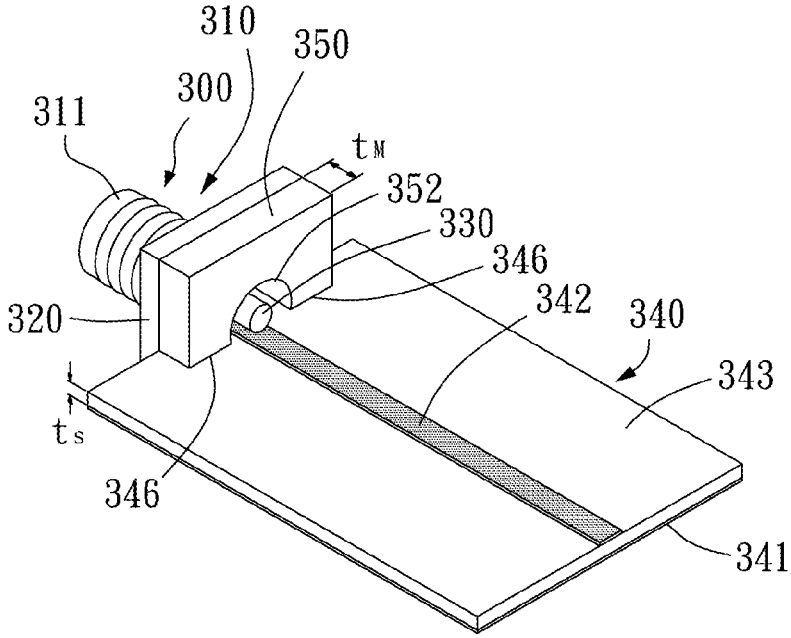
FIG. 3B is the schematic view of a transition between a coaxial line and a microstrip line using a preferred embodiment of the present invention.
Figure 3C:
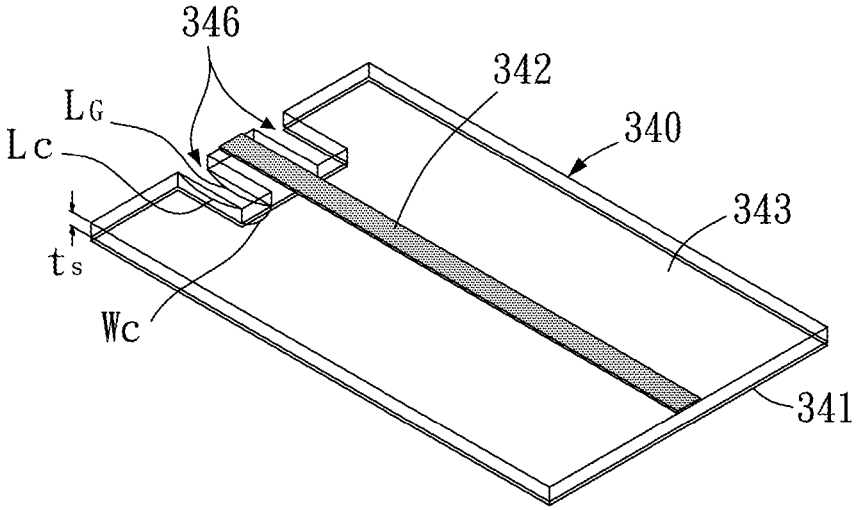
FIG. 3C is the schematic perspective view of a microstrip line for the present invention.

With reference to FIGS. 3A to 3C for the schematic decomposed view of a preferred embodiment of the present invention, the schematic view of a transition between a coaxial line and a microstrip line using the preferred embodiment of the present invention, and the schematic perspective view of the microstrip line for the present invention, respectively, a connector 300 (FIGS. 3A, 3B) of the present invention is employed to connect the coaxial line (not shown) and the microstrip line 340 (FIGS. 3B, 3C). As shown in FIGS. 3A and 3B, the microstrip line 340 has a signal line 342, a substrate 343, and a ground plane 341. The signal line 342 is on one side of the substrate 343, and the ground plane 341 is on the other side. Two slots 346 are cut on the edge of the substrate 343 of the microstrip line 340 near the transition and are separated by the signal line 342, as shown in FIG. 3C. The ground plane 341 of the microstrip line 340 between the two slots 346 must be removed. The connector 300 has two parts, a coaxial connector 310 and a metallic plate 350. As shown in FIGS. 3A and 3B, the coaxial connector 310 has an outer conductor 311, a dielectric material 322 (FIG. 3A), a mounting wall 320, and a center conductor 330. The space between the outer conductor 311 and the center conductor 330 is filled with the dielectric material 322. The center conductor 330 is extended from the inside of the coaxial connector 310 to the other side of the mounting wall 320. The dielectric material 322 can be Teflon® or any other equivalent material, such as polytetrafluoroethylene (PTFE). The metallic plate 350 has a through hole 352 and is attached to the mounting wall 320 of the coaxial connector 310. The outside center conductor 330 of the coaxial connector 310 is placed within the through hole 352. For the connector 300 of the present invention, the coaxial connector 310 is used to connect the coaxial line. As shown in FIG. 3B, the through hole 352 contains the microstrip line 340 between the two slots 346 with its ground plane 341 removed. The two slots 346 enable the metallic plate 350 to encircle the ground plane-removed microstrip line 340. The outside center conductor 330 is in direct contact with the signal line 342 of the ground plane-removed microstrip line 340 within the through hole 352. And the metallic plate 350 is electrically connected to the ground plane 341 of the microstrip line 340.

Figure 4:
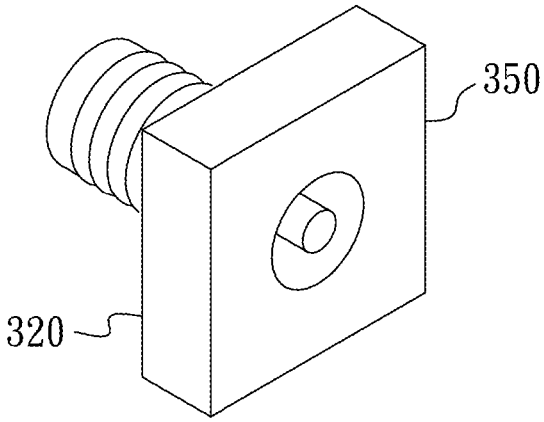
FIG. 4 is the schematic view of another preferred embodiment of the present invention.

With reference to FIG. 4 for the schematic view of another preferred embodiment of the present invention and FIG. 3A, the mounting wall 320 and the metallic plate 350 can be integrated into one unit to reduce the manufacture cost and to simplify the assembly process.

Besides the flange-mount SMA connector, the connector 300 of the present invention can be developed into a different connector. The coaxial connector 310 of the aforementioned preferred embodiment can be an SMB, SSMA, 1.85 mm, 2.4 mm, 2.9 mm, 3.5 mm, 7 mm, K, N, TNC, or other coaxial connectors to improve the frequency responses of transitions between any of these coaxial connectors and the microstrip line 340 at high frequencies.

The combination of the metallic plate 350 and the center conductor 330 within its through hole 352 form a coaxial line without any dielectric material. This design provides a buffer area to prevent the electromagnetic field distribution of the coaxial line changing rapidly at the transition. One of the features of the present invention is the attachment of the metallic plate 350 to the mounting wall 320. Its main function is to provide a buffer area for the transformation of electromagnetic field distributions at the transition and, thus, to improve the transmission characteristics of the transition at high frequencies.

With reference to FIG. 3B, the aforementioned connector 300 is embedded in the microstrip line 340 through the metallic plate 350 attached to the mounting wall 320. The center conductor 330 is connected to the signal line 342 of the microstrip line 340. As can be seen in FIG. 3B, the metallic plate 350 serves as a buffer area for the transformation of the electromagnetic field distributions at the transition between the coaxial line and the microstrip line 340. In addition, the center conductor 330 can be either in direct contact with the signal line 342 or soldered to it. The difference in their frequency responses is insignificant.

With reference to FIG. 3C, the metallic plate 350 requires two slots 346 on the microstrip line 340 to encircle the microstrip line 340. The optimum length $L_C$ of the slots 346 is equal to the thickness $t_M$ (FIGS. 3A, 3B) of the metallic plate 350. The optimum width $W_C$ of the slots 346 is designed to be the dimension that the metallic plate 350 can precisely encircle the microstrip line 340. However, those who are experts in this technique should understand that the width $W_C$ of the slots 346 in the present invention can be further extended outward as long as the metallic plate 350 can encircle the microstrip line 340 through the slots 346. In addition, the configuration of the slots 346 for this preferred embodiment is rectangular. It is noteworthy that other configurations of the slots can be used for the present invention as well, provided the dimensions of the substrate 343 within the through hole 352 of the metallic plate 350 remain unchanged.

The existence of the slots 346 would alter the characteristics of the microstrip line 340 within the through hole 352 of the metallic plate 350 and generate a resonant circuit. Particularly, the resonant circuit resonates at frequency between 10 to 15 GHz if the $L_C$ is equal to 3 mm. That would seriously affect the performance of the transition. The solution to this problem is to remove the ground plane 341 of the microstrip line 340 within the through hole 352 of the metallic plate 350. Thus, the resonant frequency response can be eliminated and the frequency response in passband becomes flat. In this preferred embodiment, the length $L_G$ of the removed ground plane 341 is equal to the thickness $t_M$ of the metallic plate 350.

Furthermore, the metallic plate 350 and the center conductor 330 within its through hole 352 form a coaxial line with no dielectric material. Therefore, that portion of the microstrip line 340 with its ground plane 341 removed can be inserted into the space between the inner surface of the through hole 352 and the center conductor 330. Then, the center conductor 330 is in direct contact with the signal line 342. Such arrangement can gradually transform the electromagnetic field distribution of the coaxial line into the electromagnetic field distribution of the microstrip line 340 within the through hole 352 of the metallic plate 350. That would reduce the insertion loss caused by the transformation of the electromagnetic field distributions of the two transmission lines at their transition.

In the preferred embodiment of the present invention, if an SMA connector is used, the substrate 343 selected for the microstrip line 340 has a dielectric constant of 3.38, a thickness $t_S$ (FIGS. 3A, 3B) of 0.813 mm, and dimensions of 20 mm×30 mm. The metallic plate 350 has a thickness $t_M$ (FIGS. 3A, 3B) ranging from 1.5 mm to 6 mm, or greater than 6 mm, and an optimum value of 3 mm. The through hole 352 has a radius $r_M$ (FIG. 3A) ranging from 1.757 mm to 2.307 mm, or greater than 2.307 mm, and an optimum value of 2.057 mm. The edge of the metallic plate 350 is in perfect alignment with the edge of the mounting wall 320. The metallic plate 350 and the mounting wall 320 both have the same square configuration, the same dimensions of 12.7 mm×12.7 mm. The length $L_T$ (FIG. 3A) of the center conductor 330 extended from the coaxial connector 310 and placed within the through hole 352 of the metallic plate 350 is equal to the thickness $t_M$ of the metallic plate 350, and has an optimum value of 3 mm. The ground plane of the microstrip line 340 within the through hole 352 of the metallic plate 350 must be removed to prevent any resonance response.

In another preferred embodiment, the length $L_T$ of the center conductor 330 can be longer, such as 4 mm or more, or shorter, such as 1 mm or less.

Figure 1A:
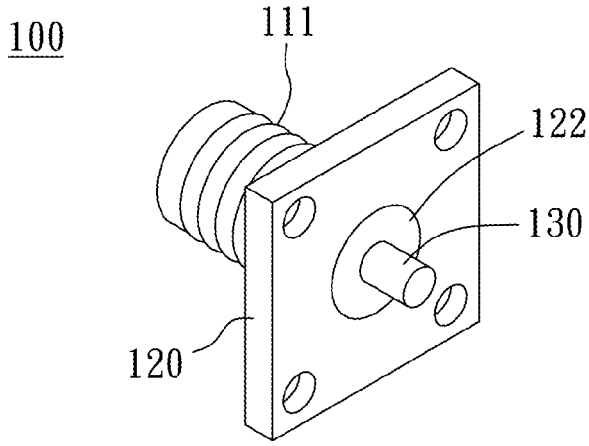
(PRIOR ART) Fig. 1A
FIG. 1A is the schematic view of a conventional flange-mount SMA connector.
Figure 1B:
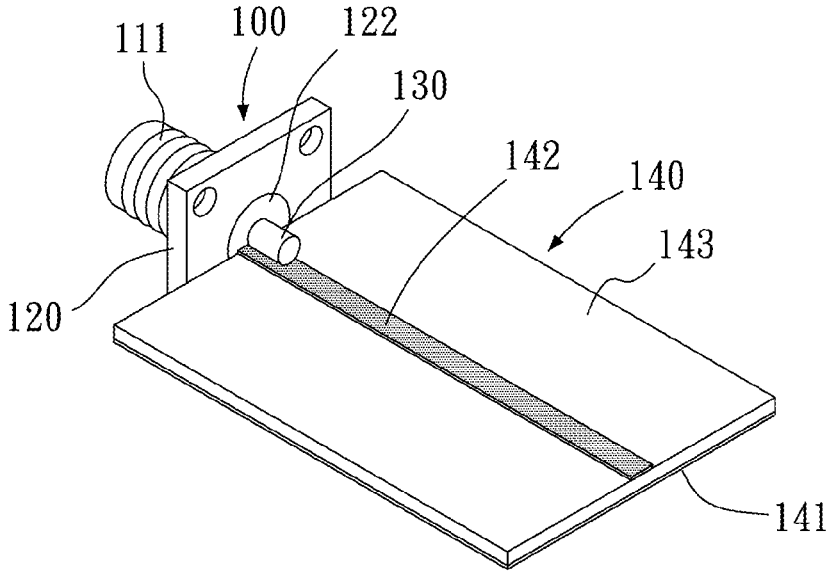
(PRIOR ART) Fig. 1B
FIG. 1B is the schematic view of a transition between a coaxial line and a microstrip line using a conventional flange-mount SMA connector.
Figure 2A:
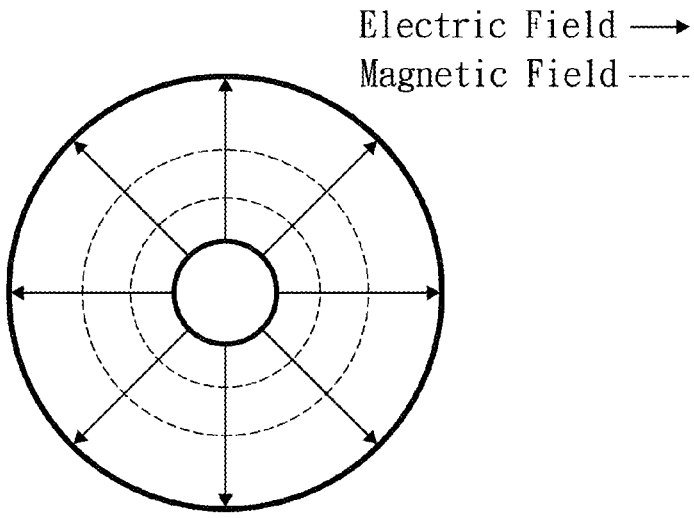
(PRIOR ART) Fig. 2A
FIG. 2A is the electric field and magnetic field distributions of a coaxial line.
Figure 2B:
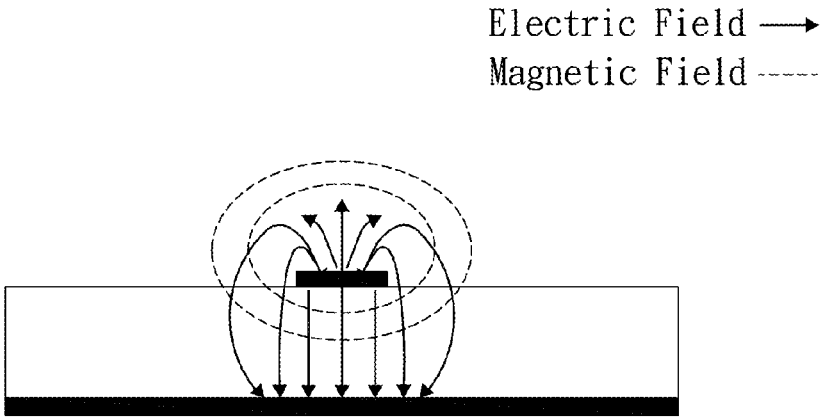
(PRIOR ART) Fig. 2B
FIG. 2B is the electric field and magnetic field distributions of a microstrip line.
Figure 5:
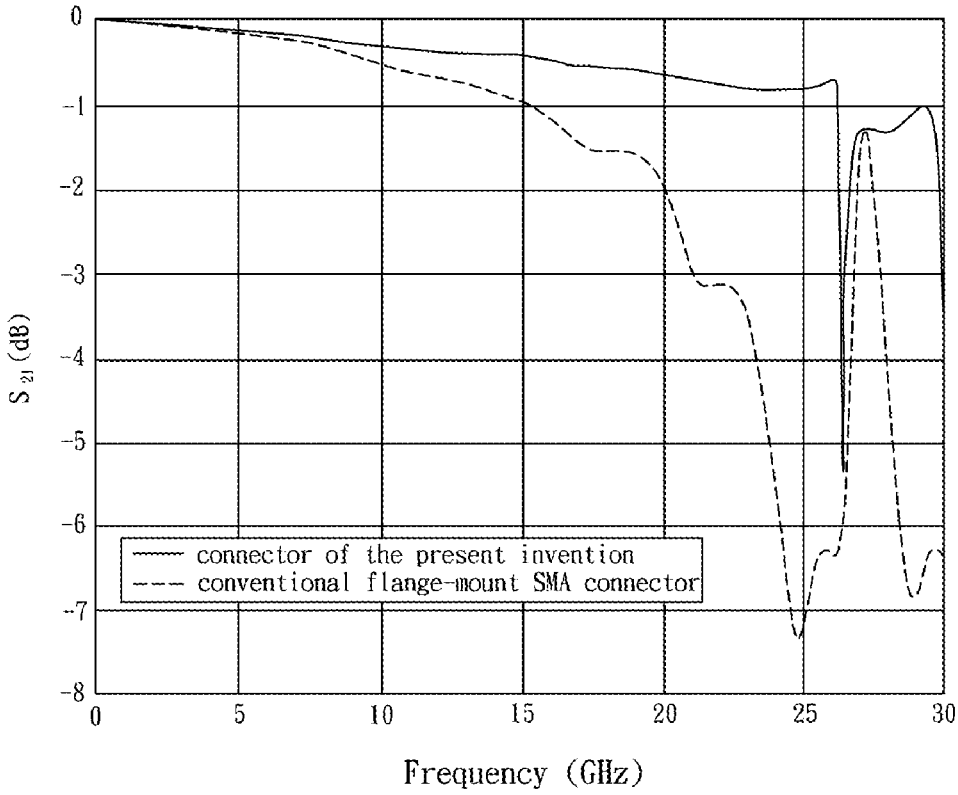
FIG. 5 is the frequency responses of transitions between a coaxial line and a microstrip line.

With reference to FIG. 5 for the frequency responses of transitions between a coaxial line and a microstrip line, the frequency response ($S_{21}$, dB) vs. frequency (Frequency, GHz) of a transition using the connector 300 of the present invention (as shown in FIG. 3A with the SMA connector) is compared with that of a transition using the conventional flange-mount SMA connector 100 (as shown in FIG. 1A). The upper limit of the 1-dB passband of the transition using the conventional flange-mount SMA connector 100 is 15 GHz. The upper limit of the 1-dB passband of the transition using the connector 300 of the present invention is 26 GHz. The 1-dB passband is increased by almost 73%. Thus, the invention can significantly improve the transmission characteristics of the transition between the two transmission lines at high frequencies.

In another preferred embodiment, the present invention can apply to a transition to a microstrip line 340 on a substrate 343 of different dielectric constant $\in_\gamma$ (6.15 or 10.2) and thickness $t_S$ (0.508 mm or 0.305 mm). All the results indicate that the connector 300 of the present invention (if the SMA connector is used) can increase the 1-dB passband of the transition between the coaxial line and the microstrip line 340.

It is noteworthy to point out that for the present invention the radius $r_M$ of the through hole 352 of the metallic plate 350 and the thickness of the metallic plate 350 are properly selected to achieve the optimum frequency response of the transition. There is no specific requirement on the size and the configuration of the metallic plate 350, however, considering the integration of the metallic plate 350 and the mounting wall 320 into one unit, the square configuration is chosen as shown in FIG. 4 to facilitate the mass production of the connector 300 of the present invention.

It has been confirmed that the present invention can apply to a connector with a different type of the coaxial connector, a transition to a microstrip line 340 on a substrate 343 of different dielectric constant and thickness, and a transition to another common planar transmission line, the coplanar waveguide. Therefore, the connector of the present invention can be used for signal transmission between a coaxial line and a planar transmission line with the features of low loss and wide 1-dB passband.

In summary, the present invention completely meets the three requirements posed by patent applications: innovation, progression, and applicability in industry. Considering the requirements on innovation and progression, the present invention uses the metallic plate 350 of the connector 300 to serve as a buffer area for the electromagnetic field transformation between a coaxial line and a microstrip line 340 at their transition. Thus, the insertion loss caused by the change of the electromagnetic field distributions of the two transmission lines is reduced. For the requirement on applicability in industry, products originated from the present invention can certainly meet the demands from the current market.

The present invention has been described by means of some preferred embodiments. However, those who are experts in this technique should be aware that these preferred embodiments are used to describe the present invention and should not be used to confine the scope of the present invention. It is noteworthy that modifications and variations made to the preferred embodiments should be covered by the scope of the present invention. The scope of the present invention is set forth in the claims.

What is claimed is:

1. A connector, used for connecting a coaxial line and a microstrip line with the microstrip line having a signal line, a substrate and a ground plane, and the signal line on one side of the substrate and the ground plane on the other side of the substrate, and two slots cut on one side of the microstrip line for the connection with the connector and said two slots separated by the signal line, and the ground plane underneath the substrate between the two slots removed thereby defining a ground plane-removed microstrip line portion, and the connector comprising:

a coaxial connector, having an outer conductor, a dielectric material, a mounting wall, and a center conductor with the space between the outer and center conductors filled with the dielectric material and the center conductor extended from an interior of the coaxial connector to a location outside of the mounting wall; and a metallic plate, having a through hole with the extended center conductor placed therein, to be attached to the mounting wall;

wherein the coaxial connector is used to connect the coaxial line, and the through hole provides the space for the insertion of the ground plane-removed microstrip line portion, the ground plane-removed microstrip line portion is between the two slots, and the two slots are designed to receive the metallic plate therein to thereby encircle the ground plane-removed microstrip line portion inserted into the through hole, and the center conductor is in direct contact with the signal line, and the metallic plate is electrically connected to the ground plane of the microstrip line portion.

2. The connector of claim 1, wherein the mounting wall and the metallic plate are integrated into one unit.

3. The connector of claim 2, wherein the thickness of the metallic plate ranges from 1.5 mm to 6 mm, or greater than 6 mm.

4. The connector of claim 3, wherein the preferred value for the thickness of the metallic plate is 3 mm.

5. The connector of claim 2, wherein the through hole has a circular configuration with a radius ranging from 1.757 mm to 2.307 mm, or greater than 2.307 mm.

6. The connector of claim 5, wherein the preferred value for the radius of the through hole is 2.057 mm.

7. The connector of claim 2, wherein the coaxial connector is an SMB, SSMA, 1.85 mm, 2.4 mm, 2.9 mm, 3.5 mm, 7 mm, K, N, TNC, or other coaxial connectors.

8. The connector of claim 2, wherein the center conductor extended outward from the coaxial connector has a length equal to the thickness of the metallic plate or a length longer or shorter than the thickness.

9. The connector of claim 2, wherein the edge of the metallic plate is in perfect alignment with the edge of the mounting wall, and both the mounting wall and the metallic plate have a square configuration.

10. The connector of claim 1, wherein the through hole has a circular configuration with a radius ranging from 1.757 mm to 2.307 mm, or greater than 2.307 mm.

11. The connector of claim 10, wherein the preferred value for the radius of the through hole is 2.057 mm.

12. The connector of claim 1, wherein the thickness of the metallic plate ranges from 1.5 mm to 6 mm, or greater than 6 mm.

13. The connector of claim 12, wherein the preferred value for the thickness of the metallic plate is 3 mm.

14. The connector of claim 1, wherein the center conductor extended outward from the coaxial connector has a length equal to the thickness of the metallic plate or a length longer or shorter than the thickness.

15. The connector of claim 1, wherein the coaxial connector is an SMB, SSMA, 1.85 mm, 2.4 mm, 2.9 mm, 3.5 mm, 7 mm, K, N, TNC, or other coaxial connectors.

16. The connector of claim 1, wherein the edge of the metallic plate is in perfect alignment with the edge of the mounting wall, and both the mounting wall and the metallic plate have a square configuration.

* * * * *